US006863053B2

(12) United States Patent
Suzuki et al.

(10) Patent No.: US 6,863,053 B2
(45) Date of Patent: Mar. 8, 2005

(54) FUEL INJECTION APPARATUS FOR INTERNAL COMBUSTION ENGINE

(75) Inventors: Mikihiko Suzuki, Tokyo (JP); Tetsuji Kondo, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/349,020

(22) Filed: Jan. 23, 2003

(65) Prior Publication Data

US 2003/0213472 A1 Nov. 20, 2003

(30) Foreign Application Priority Data

May 15, 2002 (JP) ..... 2002-140391

(51) Int. Cl.[7] ..... F02M 55/02
(52) U.S. Cl. ..... 123/470; 123/456
(58) Field of Search ..... 123/470, 456, 123/447, 468, 469, 467

(56) References Cited

U.S. PATENT DOCUMENTS 3,776,209 A * 12/1973 Wertheimer et al. ..... 123/470
4,206,725 A * 6/1980 Jenkel et al. ..... 123/470
5,499,612 A * 3/1996 Haughney et al. ..... 123/470
5,566,658 A * 10/1996 Edwards et al. ..... 123/470
5,765,534 A * 6/1998 Brown et al. ..... 123/470
6,196,194 B1 * 3/2001 Mitchell ..... 123/470
6,269,798 B1 * 8/2001 Takahashi et al. ..... 123/470
6,314,943 B1 * 11/2001 Burch et al. ..... 123/470
6,431,152 B1 * 8/2002 Estacio ..... 123/470
6,622,700 B2 * 9/2003 Lee et al. ..... 123/456

FOREIGN PATENT DOCUMENTS

| | | |
|---|---|---|
| EP | 0964151 | 12/1999 |
| JP | 11-82241 A | 3/1999 |
| JP | 11-117822 A | 4/1999 |
| JP | 2000-18127 A | 1/2000 |
| JP | 2001-90630 A | 4/2001 |
| JP | 2001-329930 A | 11/2001 |

* cited by examiner

*Primary Examiner*—Mahmoud Gimie
(74) *Attorney, Agent, or Firm*—Sughrue Mion, PLLC

(57) ABSTRACT

A fuel injection apparatus in which a fuel injector, a stopper and a fuel delivery pipe can be efficiently assembled. The fuel injector, the stopper and the fuel delivery pipe are preliminarily connected in a predetermined positional relationship, and supported and secured by a resinous holder, a metal plate holder or the like. As a result, it becomes possible to handle the fuel injector, the stopper and the fuel delivery pipe as one part.

12 Claims, 10 Drawing Sheets

FUEL INJECTION APPARATUS FOR INTERNAL COMBUSTION ENGINE

BACKGROUND OF THE INVENTION

1. Field of the Invention

The present invention relates to a fuel injection apparatus and, more specific, to a fuel injection apparatus including a fuel injector that injects and supplies a fuel into a combustion chamber of an internal combustion engine such as a gasoline engine.

2. Description of the Related Art

As disclosed in, for example, the Japanese Patent Publication (unexamined) No. 351095/1999, an internal combustion engine includes a plurality of cylinder heads, and in which fuel injectors are mounted in the state of being secured respectively to each of the cylinder heads by a stopper, and a fuel is supplied from one fuel delivery pipe via a branch part of the delivery pipe to each fuel injector. FIG. 14 is an exploded perspective view for explaining a connection state between the mentioned members. In the drawing, reference numeral 1 designates a fuel delivery pipe, and numeral 11 (portion enclosed by one-dot chain line) designates a branch part of the fuel delivery pipe 1. Numeral 2 designates a fuel injector. Numeral 3 designates a stopper, numeral 4 designates an internal combustion engine, and numeral 41 designates a cylinder head of the internal combustion engine 4. In addition, all of the arrows in FIG. 14 show respectively a moving direction for incorporating each member at the time of assembling a fuel injection apparatus, which is the same as in FIG. 1 onward described later.

The stopper 3 includes a bolt insertion hole 31 and a gripper 32 for gripping the fuel injector 2. A bolt 412 is inserted through the bolt insertion hole 31 and screwed into a tapped hole 411 that is provided in the cylinder head 41, whereby the stopper 3 is secured to the cylinder head 41. The fuel injector 2 is gripped at a body thereof by the gripper 32 of the stopper 3, which is secured to each cylinder head 41, as well as a tip portion of this injector 2 is mounted onto a fuel injector mounting hole 413, thereby being secured to the cylinder head 41. Furthermore, the fuel delivery pipe 1 is connected to the other end of each fuel injector 2 at the branch part 11 thereof. Thus, fuel is supplied to each fuel injector 2 through the branch part 11 from the fuel delivery pipe 1, and injected into the combustion chamber of the internal combustion engine 4 from the injection port that is provided at the tip end of each fuel injector 2.

Meanwhile, in assembly operation at a factory of the fuel injection apparatus, hitherto the fuel delivery pipe 1, the fuel injector 2 and the stopper 3 have been supplied to the mentioned factory in the state of individual parts separate from one another. Then these individual parts are incorporated into the semi-manufactured internal combustion engine in the factory. In this case, it is required that a necessary axial adjustment or positioning between the parts is successfully achieved. However, there exist various problems as follows. One of these problems exists in that it comes to be difficult to insert and mount the stopper 3 in and on a predetermined position from outside due to restrictions in space for assembling, because of a recent trend of demanding downsizing or much higher-performance of an internal combustion engine. Another problem exists in that an electrical connector (not shown) can be connected to the fuel injector 2 only from a specific direction in the case where a fuel spray configuration of the fuel injector 2 is not axially symmetrical owing to requirements in combustion performance of the internal combustion engine 4, or due to restrictions in configuration of the periphery of the internal combustion engine 4. A further problem exists in that it is necessary to secure, at a specific angle, the fuel injector 2 with respect to the internal combustion engine 4 and the fuel delivery pipe 1. Thus, it comes to be difficult to implement an individual assembly method in situ in the conventional manner.

SUMMARY OF THE INVENTION

The present invention was made in view of the above-discussed problems in the art and has an object of providing a fuel injection apparatus in which a fuel injector, a stopper and a fuel delivery pipe can be efficiently.

A fuel injection apparatus according to the invention includes: a fuel injector that is mounted onto a cylinder head of an internal combustion engine and injects a fuel into a combustion chamber of the mentioned internal combustion engine; a stopper for securing the mentioned fuel injector to the mentioned cylinder head; and a fuel delivery pipe that includes a branch part and supplies a fuel to the mentioned fuel injector via the mentioned branch part; and in which the mentioned fuel injection apparatus further includes a holder that integrates the mentioned fuel injector, the mentioned stopper and the mentioned fuel delivery pipe in a predetermined connection.

In the fuel injection apparatus of above construction, the fuel delivery pipe, the fuel injector and the stopper are supported and secured by the holder in the state of holding a specific relative positional relation. An integral article obtained in this manner can be handled as one part during a mounting work thereof onto the internal combustion engine, eventually resulting in an advantage that the mentioned mounting work is greatly improved in efficiency.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Preferred Embodiments of the Invention

Figure 14:
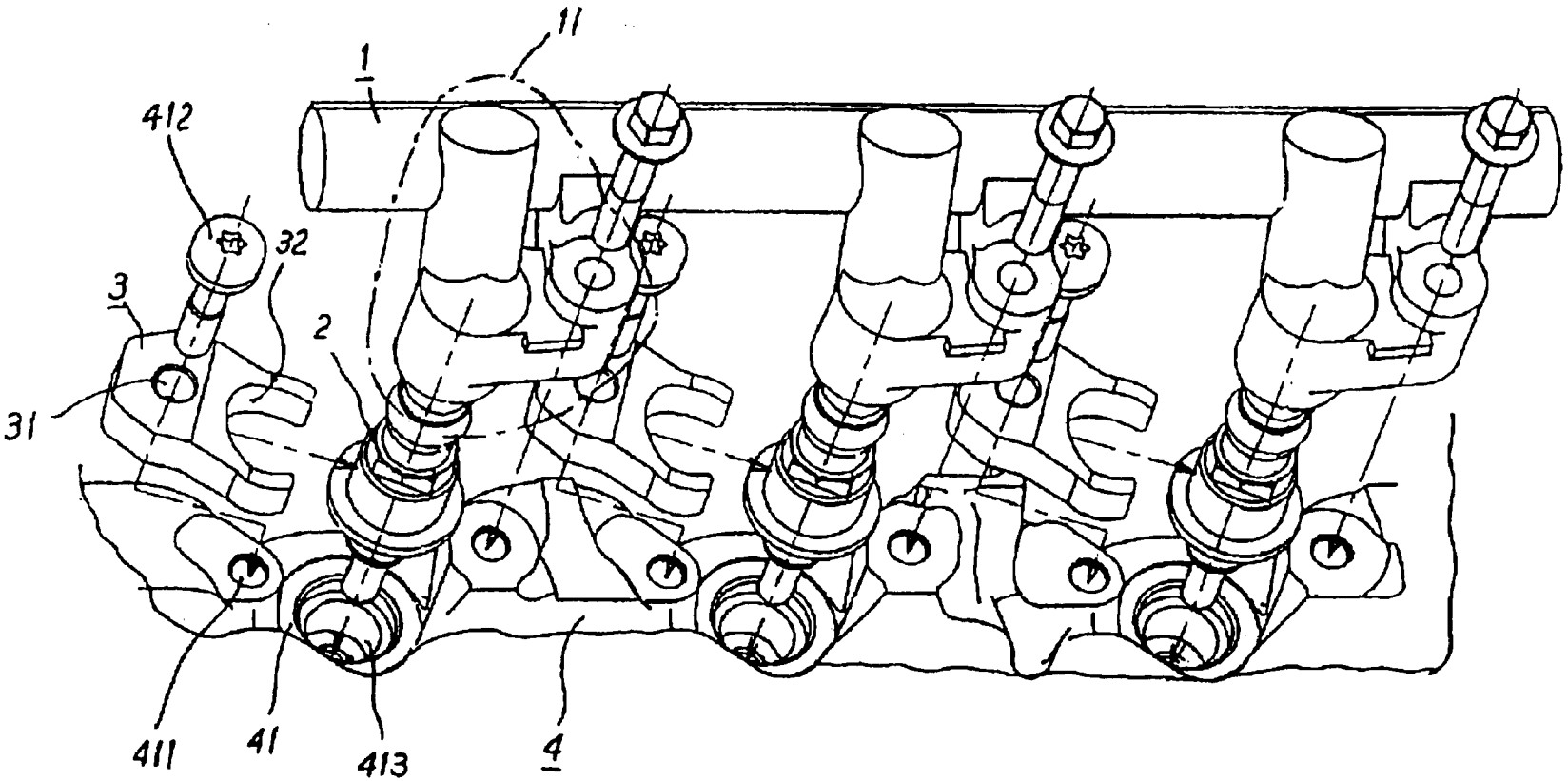
Fig. 14 (PRIOR ART)
FIG. 14 is a perspective view showing a layout state before assembling this type of related members according to a prior art.

In the following first preferred embodiment, the same reference numerals are designated to the same parts as those in the foregoing FIG. 14. Further in embodiments subsequent to the first embodiment, the same numerals are designated to the same parts as in the preceding embodiments, and description thereof may be omitted therein.

Embodiment 1.

Figure 1:
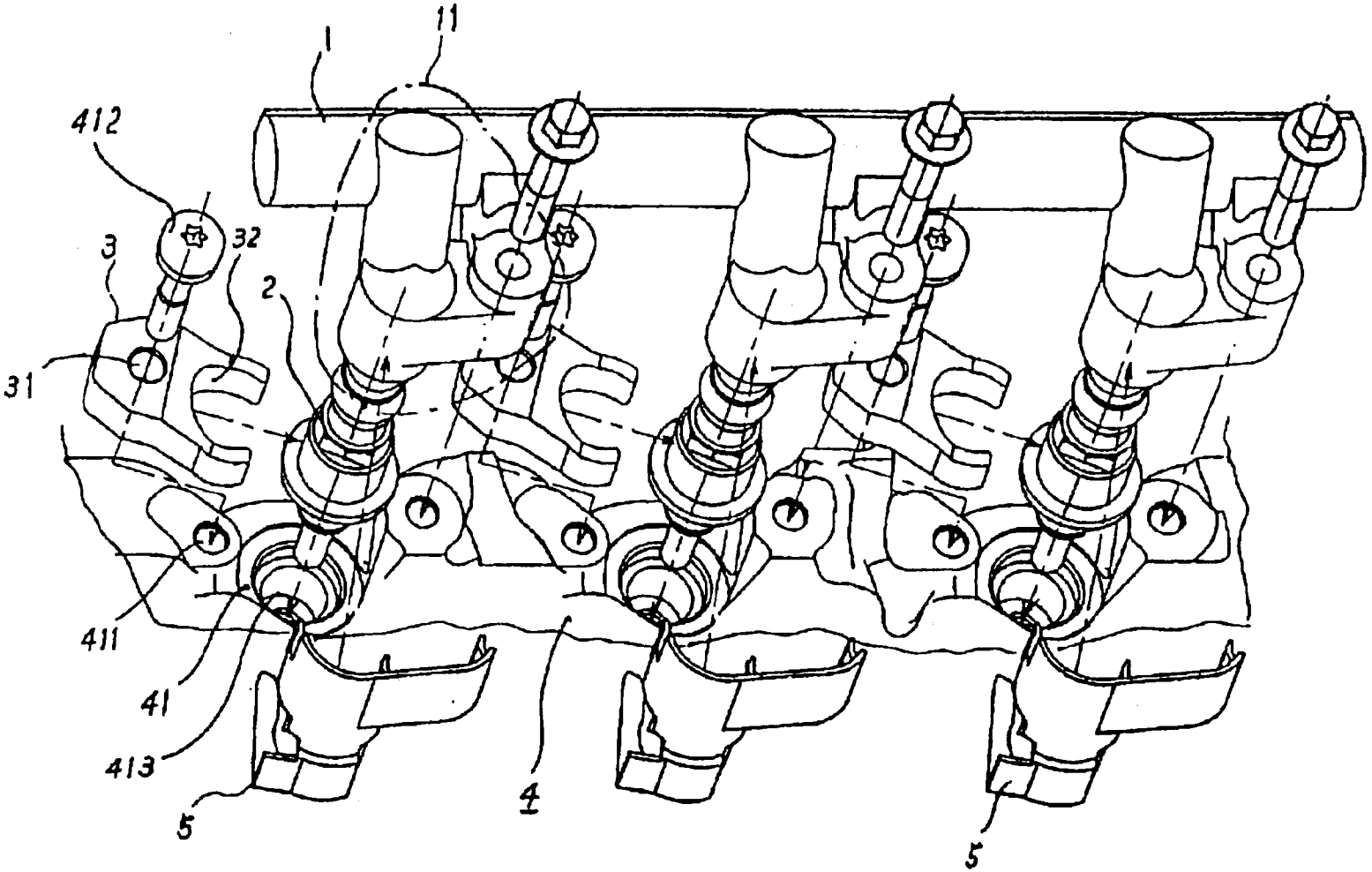
FIG. 1 is a perspective view showing a layout state of the related members before assembling according to a first preferred embodiment of the present invention.
Figure 2:
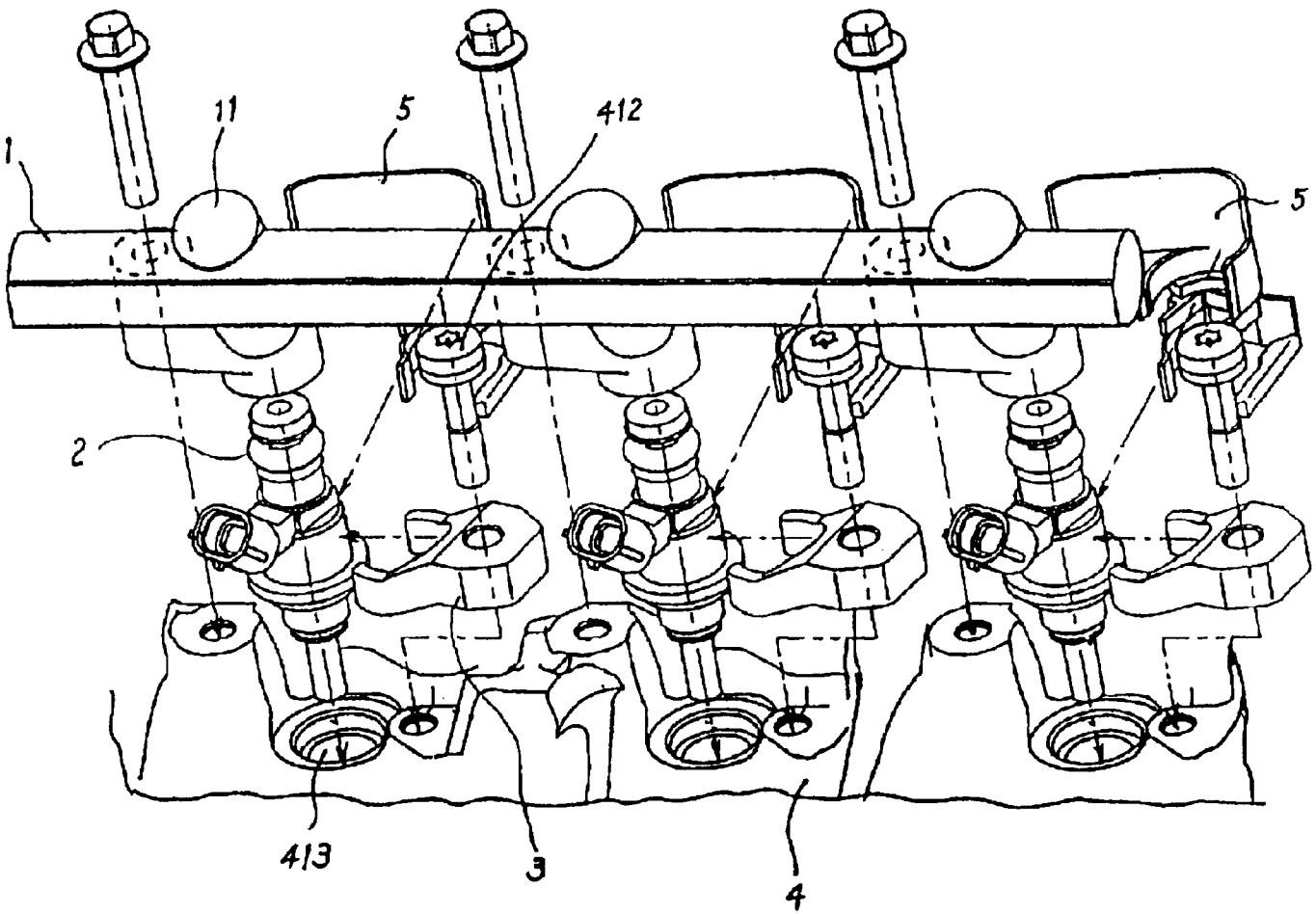
FIG. 2 is a perspective view showing a layout state taken in the other direction of the related members before assembling according to the first embodiment.
Figure 3:
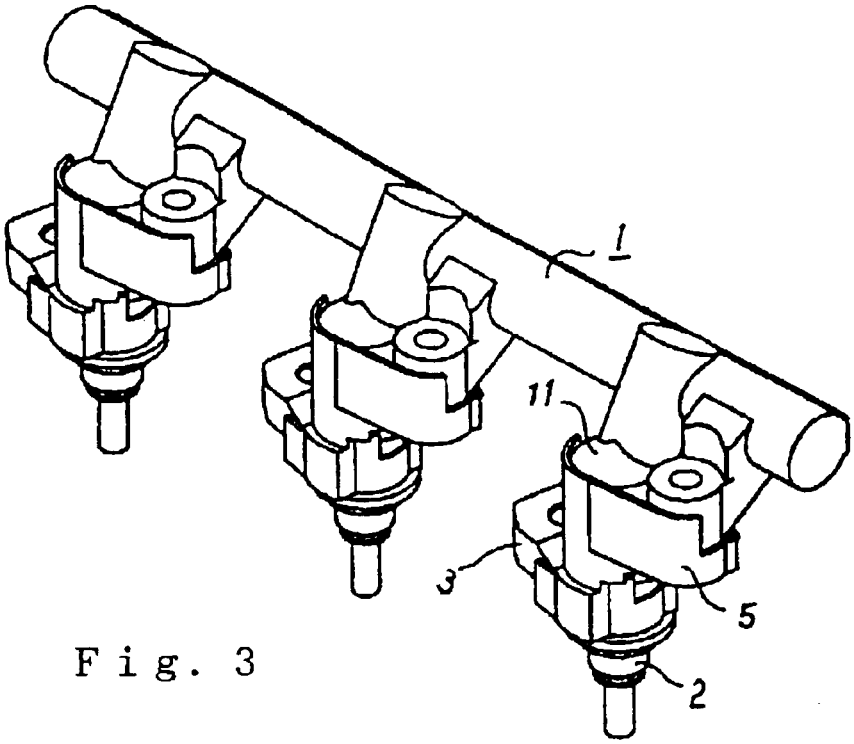
FIG. 3 is a perspective view showing an assembly obtained by assembling the related members of FIG. 1 before mounting the assembly onto an internal combustion engine.
Figure 4:
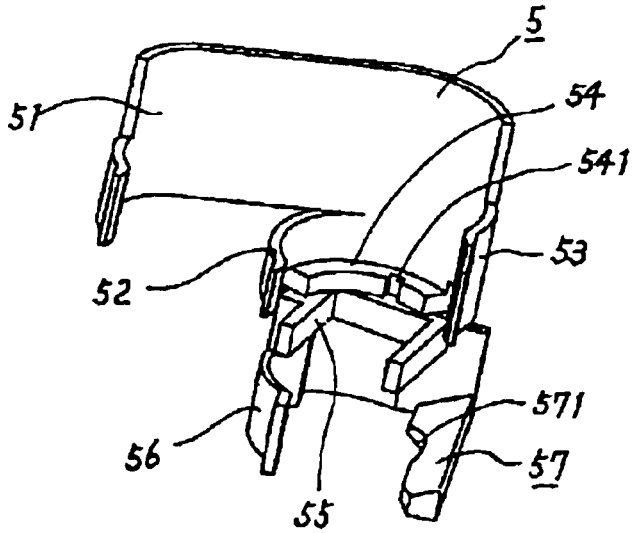
FIG. 4 is a perspective view showing a resinous holder used in the first embodiment.
Figure 5:
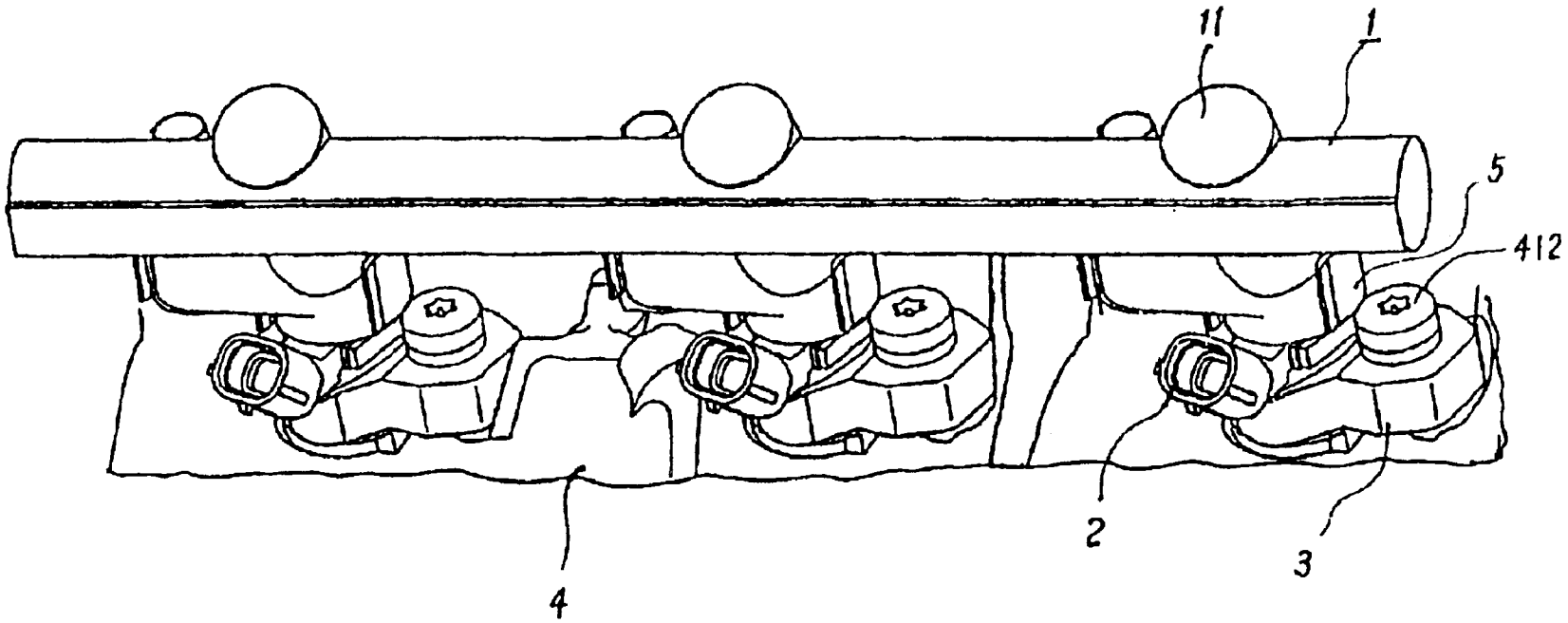
FIG. 5 is a perspective view showing a state of the assembly of FIG. 3 being mounted onto the internal combustion engine.

FIGS. 1 to 5 are to explain a fuel injection apparatus according to a first embodiment of the invention. FIG. 1 is a perspective view showing a layout of related members before assembling according to the first embodiment, and FIG. 2 is a perspective view showing the layout taken at a different angle from FIG. 1 of the related members before assembling according to the first embodiment. FIG. 3 is a perspective view showing an assembly obtained by assembling the mentioned related members before mounting the assembly onto an internal combustion engine, FIG. 4 is a perspective view showing a resinous holder as one example of the mentioned holder, and FIG. 5 is a perspective view showing a state of the mentioned assembly being mounted onto the internal combustion engine.

Referring now to FIGS. 1 to 5, numeral 5 designates a resinous holder. This resinous holder 5 is integrally constructed of a portion 51 made of a plate material of great length and width, a portion 52 made of a plate material of small length and width, a portion 53 made of a plate material of medium length and width, a protruded portion 54, a protruded portion 55, a portion 56 made of a plate material of medium length and width, and a protruded portion 57. Further, the portions 54 and 57 are provided with depressions 541 and 571 respectively.

In assembling a plurality of fuel injectors 2 (three valves in the drawings), the fuel delivery pipe 1 and the stoppers 3 shown in FIGS. 1 and 2, each fuel injector 2 and each branch part 11 of the fuel delivery pipe 1 are connected so as to stand in a specific relative positional relationship. Then, the gripper 32 of the stopper 3 is fitted to the body of the fuel injector 2, and the fuel injector 2 and the stopper 3 are brought into the state of being connected with each other in a specific relative positional relationship. Thereafter, the resinous holder 5 is applied thereto, and the fuel injector 2 is supported and secured to this resinous holder 5 with the portions 54, 55 and 56 of the resinous holder 5. At this time, it is preferable that a positioning member (not shown), which resides on an outer wall of the fuel injector 2, is fitted into the depression 541, thereby causing the fuel injector 2 and the resinous holder 5 to be positioned. Additionally, it is also preferable that the mentioned positioning member of the fuel injector 2 is provided separately, or that an appropriate protrusion, which normally resides on the outer wall of the fuel injector 2, is utilized as the positioning member. In that case, it is preferable that the depression 541 has been preliminarily provided at a position where the foregoing protrusion resides. The stopper 3 is supported and secured to the foregoing holder 5 with the portions 56 and 57 thereof. At this time, an exterior surface of the gripper 32 of the stopper 3 is fitted into the depression 571 of the portion 57 to be positioned with respect to the resinous holder 5. The fuel injector 2 and the branch part 11 cause the portions 51 to 53 of the resinous holder 5 to be deformed so as to be in conformity with an exterior surface configuration of the connection portion between the two members, eventually to be secured in the state that the mentioned relative positional relationship between the fuel injector 2 and the branch part 11 is maintained. Thus, an assembly shown in FIG. 3 is obtained.

The assembly, shown in FIG. 3, is supported and secured with respect to one another by the resinous holder 5 in the state that a specific relative positional relationship among the fuel delivery pipe 1, the fuel injector 2 and the stopper 3 is held. Therefore, this assembly is placed on the internal combustion engine 4 (see FIGS. 1 and 2), and a tip portion of the fuel injector 2 is mounted into the fuel injector-mounting hole 413 of the cylinder head 41 via a seal member. On the other hand, the bolt 412 is inserted into the bolt insertion hole 31 of the stopper 3 to be threaded into the tapped hole 411 provided in the cylinder head 41, whereby the foregoing assembly can be mounted onto the internal combustion engine 4 as shown in FIG. 5.

Embodiment 2.

Figure 6:
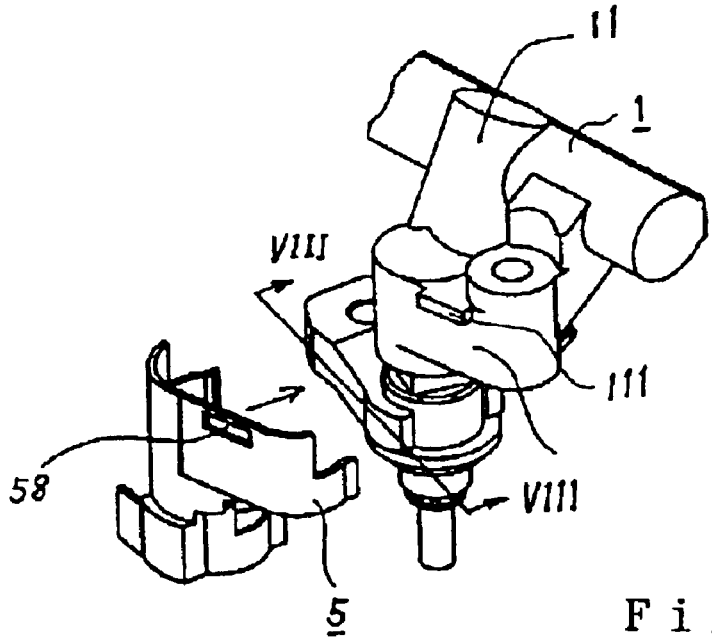
FIG. 6 is a perspective view showing a layout state of related members before assembling according to a second embodiment.
Figure 7:
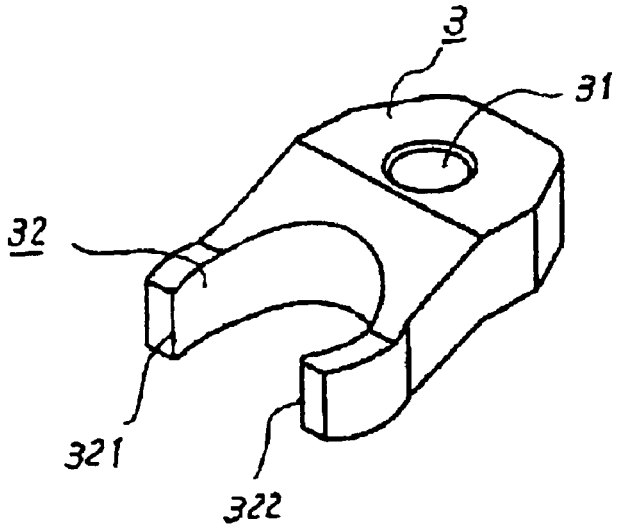
FIG. 7 is a perspective view showing a stopper used in the construction of FIG. 6.
Figure 8:
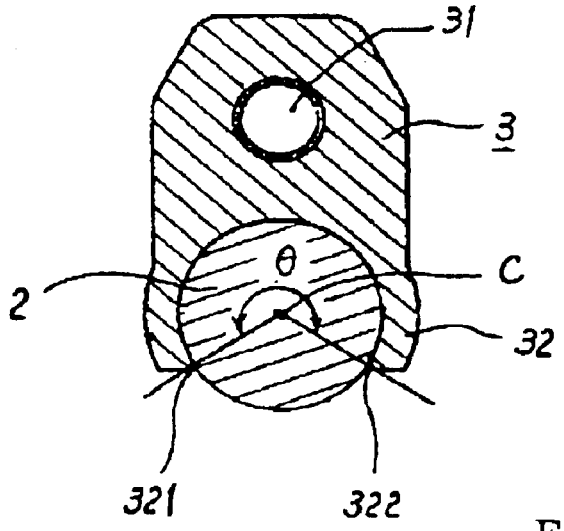
FIG. 8 is a cross sectional view taken along the line VIII—VIII of FIG. 6.

FIGS. 6 to 8 are to explain a fuel injection apparatus according to a second preferred embodiment of the invention. FIG. 6 is a perspective view showing a layout of the related members before assembling according to the second embodiment. FIG. 7 is a perspective view showing the stopper 3 used in the embodiment shown in FIG. 6. FIG. 8 is a cross sectional view taken along the line VIII—VIII of FIG. 6. Note that a plurality of fuel injectors 2 are used normally, however, only one fuel injector is typically shown in FIG. 6. Further, in FIG. 8, the fuel injector 2 is shown only at a circular periphery of the body thereof, and a detailed internal structure thereof is omitted. With reference to FIG. 6, numeral 111 designates a protrusion for positioning that is provided on the branch part 11. Numeral 58 designates a positioning hole provided in the resinous holder 5. With reference to FIGS. 7 and 8, C designates a central axis of the fuel injector 2. Numerals 321 and 322 designate tip ends of the gripper 32 of the stopper 3. θ designates an angle to be defined by connecting the mentioned central axis C with the foregoing both tip ends 321 and 322. The branch part 11 and the resinous holder 5 used in the second embodiment are different from those used in the first embodiment in the aspect that the branch part 11 and the resinous holder 5 are provided with the protrusion 111 and the hole 58 respectively, and the other construction is the same as in the first embodiment. Meanwhile, the stopper 3 used in the second embodiment is different from that used in the first embodiment in the aspect that the mentioned angle θ is greater than 180°, and the other construction is the same as in the first embodiment.

The branch part 11 of the fuel delivery pipe 1, the fuel injector 2, the stopper 3 and the resinous holder 5 are connected so as to stand in a specific relative relationship with each other in the same manner as in the case of the foregoing first embodiment. At this time, however, the protrusion 111 of the branch part 11 is fitted into the hole 58 of the resinous holder 5. This fitting makes the positioning between the branch part 11 and the fuel injector 2 much more assured than in the case of the foregoing first embodiment. Furthermore, the mentioned angle θ is greater than 180° whereby the body of the fuel injector 2 is gripped beyond a half round thereof by the gripper 32 of the stopper 3. Accordingly, it becomes hard for the fuel injector 2 to get out of the stopper 3 in radial direction, thereby making it more assured for the fuel injector 2 to be gripped by the stopper 3.

Embodiment 3.

Figure 9:
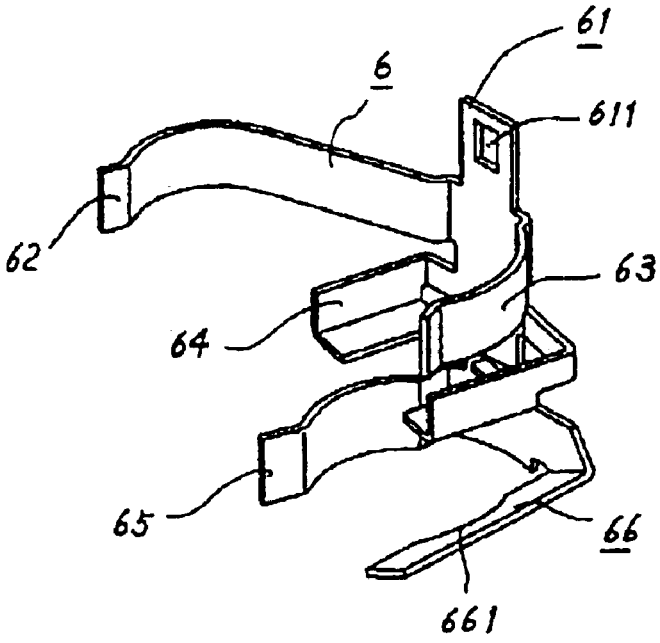
FIG. 9 is a perspective view showing a metal plate holder used in a third embodiment.

FIG. 9 is to explain a fuel injection apparatus according to a third preferred embodiment of the invention, and is a perspective view showing a metal plate holder 6 that is employed in the third embodiment acting as an alternative of the mentioned holder. The metal plate holder 6 is integrally constructed of a back plate 61, portions 62 and 63 made of a long and strip-shaped plate material extending to both right and left hands from a top portion of the back plate 61, a semi-container-shaped portion 64 provided at a middle portion of the back plate 61, a portion 65 made of a plate material of a medium length and of a strip-shape provided at a lower portion of the back plate 61 and an extending portion 66. In addition, a hole 611 is provided in the back plate 61 and a depression 661 is provided in the portion 66, respectively.

The portions 62 and 63 provide a connection between the fuel injector 2 and the branch part 11 in the same manner as the portions 51 to 53 of the mentioned resinous holder member 5. The portion 64 secures the fuel injector 2 in the same manner as the portions 54 to 56 of the mentioned resinous holder 5. The portions 65 and 66 secure the fuel injector 2 and the stopper 3 to each other in the same manner as the portions 56 and 57 of the mentioned resinous holder 5. Further, the hole 611 causes the protrusion provided on the branch part to be fitted in the same manner as the hole 58 of the resinous holder 5 in the foregoing second embodiment to position the branch part and the fuel injector. The depression 661 of the portion 66 performs a function of positioning the stopper 3 in the same manner as the depression 571 of the resinous holder 5 of the foregoing first embodiment.

Embodiment 4.

Figure 10:
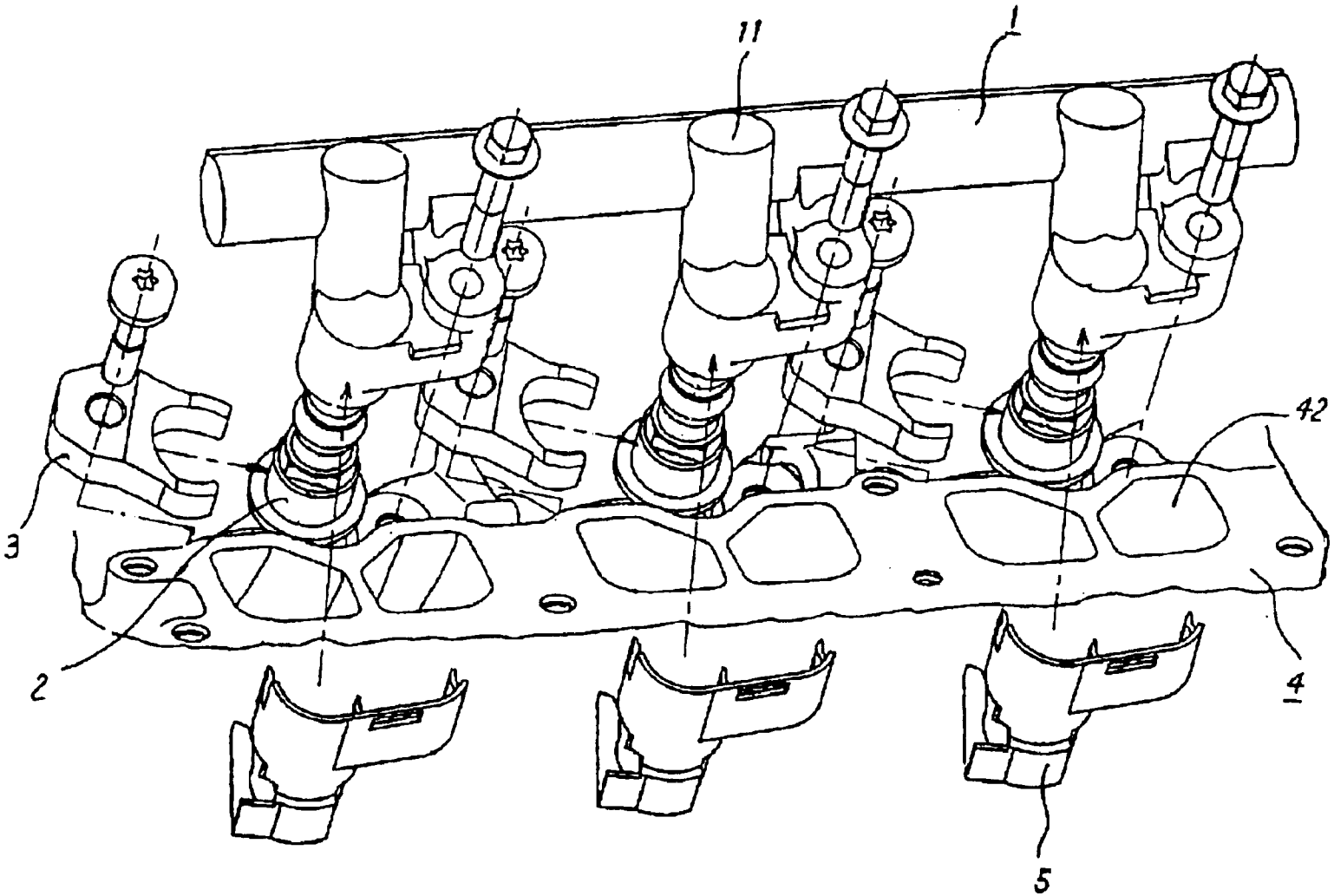
FIG. 10 is a perspective view showing a layout state of the related members before assembling according to a fourth embodiment.
Figure 11:
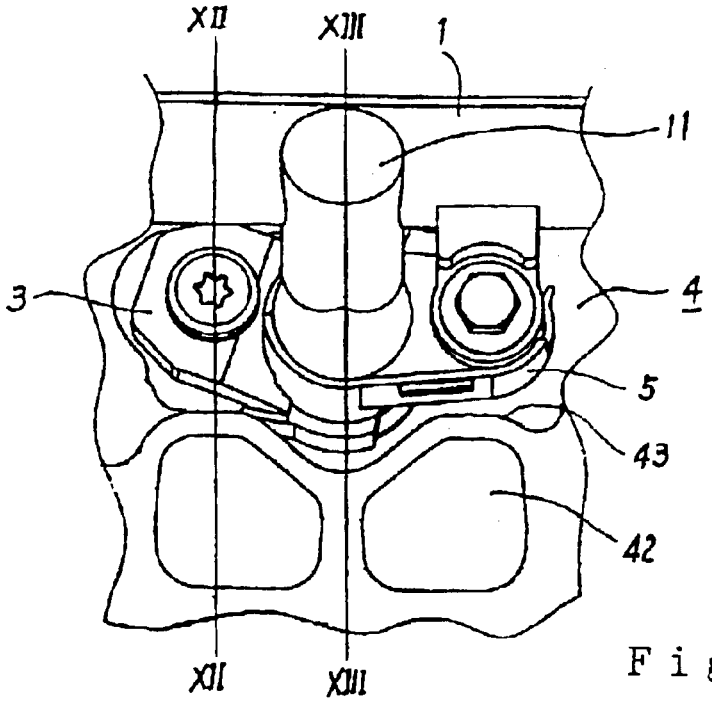
FIG. 11 is a partially perspective view showing a state of an assembly obtained by assembling the related members of FIG. 10 being mounted onto the internal combustion engine.
Figure 12:
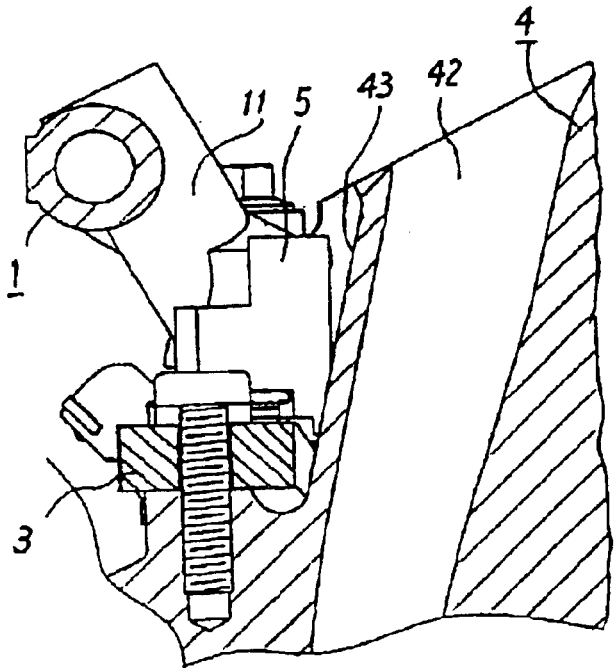
FIG. 12 is a cross sectional view taken along the line XII—XII of FIG. 11.
Figure 13:
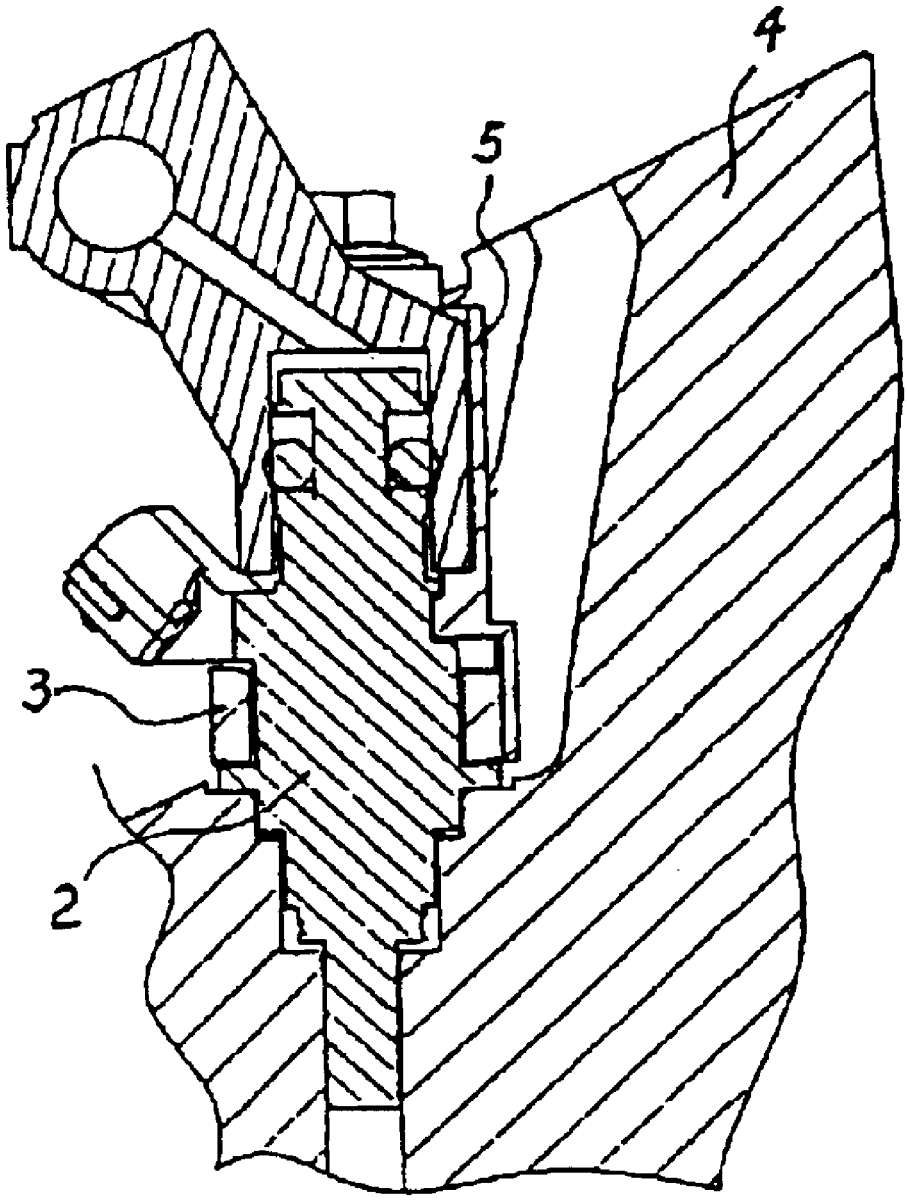
FIG. 13 is a cross sectional view taken along the line XIII—XIII of FIG. 11.

FIGS. 10 to 13 are to explain a fuel injection apparatus according to a fourth preferred embodiment of the invention. FIG. 10 is a perspective view showing a layout of the related members before assembling according to the fourth embodiment. FIG. 11 is a partial cross sectional view showing a state that an assembly obtained by assembling the mentioned related members is mounted onto the internal combustion engine. FIG. 12 is a cross sectional view taken along line XII—XII of FIG. 11. FIG. 13 is a cross sectional view taken along line XIII—XIII of FIG. 11. Referring now to FIGS. 10 to 13, numeral 42 designates an inlet port of the internal combustion engine 4. Numeral 43 designates a sidewall of the inlet port. Numeral 5 designates a holder having the same structure as the resinous holder 5 used in the foregoing second embodiment. The fuel injector 2 is located at a position proximate to the sidewall 43 of the inlet port 42 of the internal combustion engine 4. Further, the resinous holder 5 is located between the sidewall 43 and the fuel injector 2 as shown. As a result, even if a chemical deterioration of the resinous holder 5 due to practical use of the internal combustion engine 4 over a long time brings about a reduction in resilience-holding power or deformation, the resinous holder 5 is prevented from being dropped out of, e.g., the fuel injector 2.

Having described so far the invention in relation to the foregoing Embodiments 1 to 4, the invention is not limited to these embodiments, and various variations and modifications will be made without departing from the spirit and scope of the invention. For example, it is preferable that the mentioned holder is not limited to the one having a structure shown in the mentioned FIG. 4 or 9, and may furthermore be made of a flexible material other than resin or metal plate. After all, any material will be employable so long as it can function to support and secure a fuel delivery pipe, a fuel injector and a stopper respectively in a predetermined positional relationship making these members possible to be handled as one integral part in the process of manufacturing an internal combustion engine.

Now, additional features and advantages of the fuel injection apparatus according to the invention are hereinafter described.

A fuel injection apparatus according to the invention includes: a fuel injector that is mounted onto a cylinder head of an internal combustion engine and injects a fuel into a combustion chamber of the mentioned internal combustion engine; a stopper for securing the mentioned fuel injector to the mentioned cylinder head; and a fuel delivery pipe that includes a branch part and supplies a fuel to the mentioned fuel injector via the mentioned branch part; and in which the mentioned fuel injection apparatus further includes a holder that integrates the mentioned fuel injector, the mentioned stopper and the mentioned fuel delivery pipe in a predetermined connection.

As a result, the fuel delivery pipe, the fuel injector and the stopper are supported and secured by the holder in the state of holding a specific relative positional relation. An integral article obtained in this manner can be handled as one part during a mounting work thereof onto the internal combustion engine, eventually resulting in an advantage that the mentioned mounting work is greatly improved in efficiency.

It is preferable that the fuel injection apparatus is provided with positioning means for specifying a relative position between the mentioned branch part and the mentioned fuel injector or positioning means for specifying a relative position between the mentioned fuel injector and the mentioned stopper in a state that the mentioned fuel injector, the stopper and the fuel delivery pipe are integrated by the mentioned holder.

As a result, any positioning operation between the internal combustion engine and the related parts is no more unnecessary at the time of the mentioned mounting operation of the related parts onto the internal combustion engine. Consequently, an advantage is achieved in that efficiency in the mounting operation is further improved.

It is preferable that, in the fuel injection apparatus according to the invention, the mentioned holder is located between a sidewall of an inlet port of the mentioned internal combustion engine and the mentioned fuel injector disposed at a position proximate to the mentioned sidewall.

As a result, even if a chemical deterioration of the resinous holder 5 due to practical use of the internal combustion engine over a long time brings about a reduction in resilience-holding power or deformation, the resinous holder 5 is prevented from being dropped out of, e.g., the fuel injector.

It is preferable that, in the fuel injection apparatus according to the invention, the mentioned holder is made of a flexible material such as resin or metal plate.

As a result, holding operation of the fuel delivery pipe, the fuel injector and the stopper is easy and assured.

It is preferable that, in the fuel injection apparatus according to the invention, the mentioned stopper includes a gripper for gripping a body portion of the mentioned fuel injector beyond a half round thereof.

As a result, it becomes hard for the fuel injector to get out of the stopper in a radial direction thereby making it more assured for the fuel injector to be gripped by the stopper.

While the presently preferred embodiments of the present invention have been shown and described. It is to be understood that these disclosures are for the purpose of illustration and that various changes and modifications may be made without departing from the scope of the invention as set forth in the appended claims.

What is claimed is:

1. A fuel injection apparatus comprising: a fuel injector that is mounted onto a cylinder head of an internal combustion engine and injects a fuel into a combustion chamber of said internal combustion engine; a stopper for securing said fuel injector to said cylinder head; and a fuel delivery pipe that includes a branch part and supplies a fuel to said fuel injector via said branch part;

wherein said fuel injection apparatus further includes a holder that integrates said fuel injector, said stopper and said fuel delivery pipe in a predetermined connection, and wherein said fuel injection apparatus further includes positioning means for specifying a relative position between said branch part and said fuel injector in a state that said fuel injector, said stopper and said fuel delivery pipe are integrated by said holder.

2. A fuel injection apparatus comprising: a fuel injector that is mounted onto a cylinder head of an internal combustion engine and injects a fuel into a combustion chamber of said internal combustion engine; a stopper for securing said fuel injector to said cylinder head; and a fuel delivery pipe that includes a branch part and supplies a fuel to said fuel injector via said branch part;

wherein said fuel injection apparatus further includes a holder that integrates said fuel injector, said stopper and said fuel delivery pipe in a predetermined connection, and wherein said fuel injection apparatus further includes positioning means for specifying a relative position between said fuel injector and said stopper in a state that said fuel injector, said stopper and said fuel delivery pipe are integrated by said holder.

3. The fuel injection apparatus according to claim 1, wherein said holder is located between a sidewall of an inlet port of said internal combustion engine and said fuel injector disposed at a position proximate to said sidewall.

4. The fuel injection apparatus according to claim 1, wherein said holder is made of a flexible material.

5. The fuel injection apparatus according to claim 4, wherein said flexible material is resin or metal plate.

6. A fuel injection apparatus comprising: a fuel injector that is mounted onto a cylinder head of an internal combustion engine and injects a fuel into a combustion chamber of said internal combustion engine; a stopper for securing said fuel injector to said cylinder head; and a fuel delivery pipe that includes a branch part and supplies a fuel to said fuel injector via said branch part;

wherein said fuel injection apparatus further includes a holder that integrates said fuel injector, said stopper and said fuel delivery pipe in a predetermined connection, and wherein said stopper includes a gripper for gripping a body portion of said fuel injector, said gripper is operable to grip more than half the circumference of the body portion of said fuel injector.

7. A fuel injection apparatus comprising: a fuel injector that is mounted onto a cylinder head of an internal combustion engine and injects a fuel into a combustion chamber of said internal combustion engine; a stopper for securing said fuel injector to said cylinder head; and a fuel delivery pipe that includes a branch part and supplies a fuel to said fuel injector via said branch part;

wherein said fuel injection apparatus further includes a holder that integrates said fuel injector, said stopper and said fuel delivery pipe in a predetermined connection, and wherein said holder integrates said fuel injector, said stopper and said fuel delivery pipe in a predetermined connection, prior to the mounting of the fuel injector onto the cylinder head.

8. The fuel injection apparatus according to claim 1, wherein said holder integrates said fuel injector, said stopper and said branch part of said fuel delivery pipe in a predetermined connection.

9. The fuel injection apparatus according to claim 2, wherein said holder is located between a sidewall of an inlet port of said internal combustion engine and said fuel injector disposed at a position proximate to said sidewall.

10. The fuel injection apparatus according to claim 2, wherein said holder is made of a flexible material.

11. The fuel injection apparatus according to claim 10, wherein said flexible material is resin or metal plate.

12. The fuel injection apparatus according to claim 2, wherein said holder integrates said fuel injector, said stopper and said branch part of said fuel delivery pipe in a predetermined connection.

* * * * *